US007857522B2

(12) United States Patent
Osgood et al.

(10) Patent No.: US 7,857,522 B2
(45) Date of Patent: Dec. 28, 2010

(54) ROLLING MILL OIL FILM BEARING

(75) Inventors: Peter N. Osgood, Westborough, MA (US); Armando S. Martins, Cumberland, RI (US); Thomas C. Wojtkowski, Jr., Shrewsbury, MA (US); Eric L. Johanson, Worcester, MA (US); Ralph Divirgilio, Jefferson, MA (US)

(73) Assignee: Siemens Industry, Inc., Alpharetta, GA (US)

( * ) Notice: Subject to any disclaimer, the term of this patent is extended or adjusted under 35 U.S.C. 154(b) by 470 days.

(21) Appl. No.: 11/957,563

(22) Filed: Dec. 17, 2007

(65) Prior Publication Data

US 2008/0181541 A1 Jul. 31, 2008

Related U.S. Application Data

(60) Provisional application No. 60/887,419, filed on Jan. 31, 2007.

(51) Int. Cl.
*F16C 43/00* (2006.01)
*F16C 35/00* (2006.01)
*F16C 13/00* (2006.01)

(52) U.S. Cl. ..... 384/586; 384/276; 384/559; 384/584

(58) Field of Classification Search ..... 384/244, 384/256, 276, 295, 418–420, 494, 516, 559, 384/562, 584–587
See application file for complete search history.

(56) References Cited

U.S. PATENT DOCUMENTS

| | | | | |
|---|---|---|---|---|
| 2,312,648 | A * | 3/1943 | Jones | 384/192 |
| 3,080,199 | A * | 3/1963 | Rickley | 384/584 |
| 3,782,796 | A * | 1/1974 | Rickley et al. | 384/584 |
| 3,799,636 | A * | 3/1974 | Kersting et al. | 384/556 |
| 4,159,152 | A * | 6/1979 | Bjork | 384/291 |
| 4,351,576 | A * | 9/1982 | Nishide et al. | 384/276 |
| 4,352,229 | A * | 10/1982 | Moore, Jr. | 492/1 |
| 4,733,458 | A * | 3/1988 | Benfer et al. | 29/724 |
| 5,029,461 | A * | 7/1991 | Lawrence et al. | 384/556 |
| 6,149,309 | A * | 11/2000 | Wojtkowski et al. | 384/276 |
| 6,415,489 | B1 * | 7/2002 | Martins et al. | 29/252 |
| 6,575,638 | B2 * | 6/2003 | Martins et al. | 384/559 |
| 7,082,800 | B1 * | 8/2006 | Muller et al. | 72/237 |
| 7,386,939 | B2 * | 6/2008 | Di Giacomo | 384/559 |

FOREIGN PATENT DOCUMENTS

EP 1027333 A * 1/2001

* cited by examiner

*Primary Examiner*—Marcus Charles

(57) ABSTRACT

An oil film bearing assembly rotatably supports the neck of a roll in a rolling mill. The bearing assembly comprises a housing containing a sleeve bearing and a thrust bearing. A circular lock assembly coacts with the thrust bearing to axially retain the bearing assembly on the roll neck. The lock assembly is axially received on and is rotatable into and out of mechanical interengagement with the roll neck. First bearing elements are carried by and project inwardly from the lock assembly to contact a surface of the roll neck at a first location, and second bearing elements project inwardly from the housing to contact an outer surface of the lock assembly at a second location spaced axially from the first location.

9 Claims, 6 Drawing Sheets

ROLLING MILL OIL FILM BEARING

BACKGROUND OF THE INVENTION

1. Field of the Invention

This invention relates generally to oil film bearings that are used to rotatably support the necks of rolls in a rolling mill.

2. Description of the Prior Art

Rolling mill oil film bearings are typically held in place by lock assemblies that are rotated into and out of mechanical interengagement with the roll necks. In the larger size bearings, e.g., those with rolls measuring one and one half meters in diameter and larger, lock rotation requires relatively large clearances between the coacting roll neck and lock assembly surfaces, which in turn gives rise to a tendency of the lock assemblies to tilt, misalign, and bind during mounting and dismounting. This problem is further exacerbated by the weight of the larger lock assemblies, which can exceed 900 kilograms.

The objective of the present invention is to ease the task of rotating the lock assemblies into and out of mechanical interengagement with the roll necks by incorporating strategically placed bearings that encourage proper alignment while avoiding the tendency of the lock assemblies to tilt and bind.

SUMMARY OF THE INVENTION

In accordance with the present invention, an oil film bearing comprises a chock and associated end plates forming a housing that contains both sleeve bearing and thrust bearing components. A circular lock assembly coacts with the thrust bearing component to axially retain the oil film bearing on the roll neck. The lock assembly is rotatable into and out of mechanical interengagement with the roll neck. First bearing elements are carried by and project inwardly from the lock assembly to contact a surface of the roll neck at a first location. Second bearing elements project inwardly from a chock end plate of the housing to contact an outer surface of the lock assembly at a second location spaced axially from the first location. The first and second bearing elements encourage proper alignment of the lock assembly on the roll neck, thus avoiding or at least significantly minimizing the tendency of the lock assembly to tilt and bind during mounting and dismounting.

DETAILED DESCRIPTION OF ILLUSTRATED EMBODIMENTS

Figure 1:
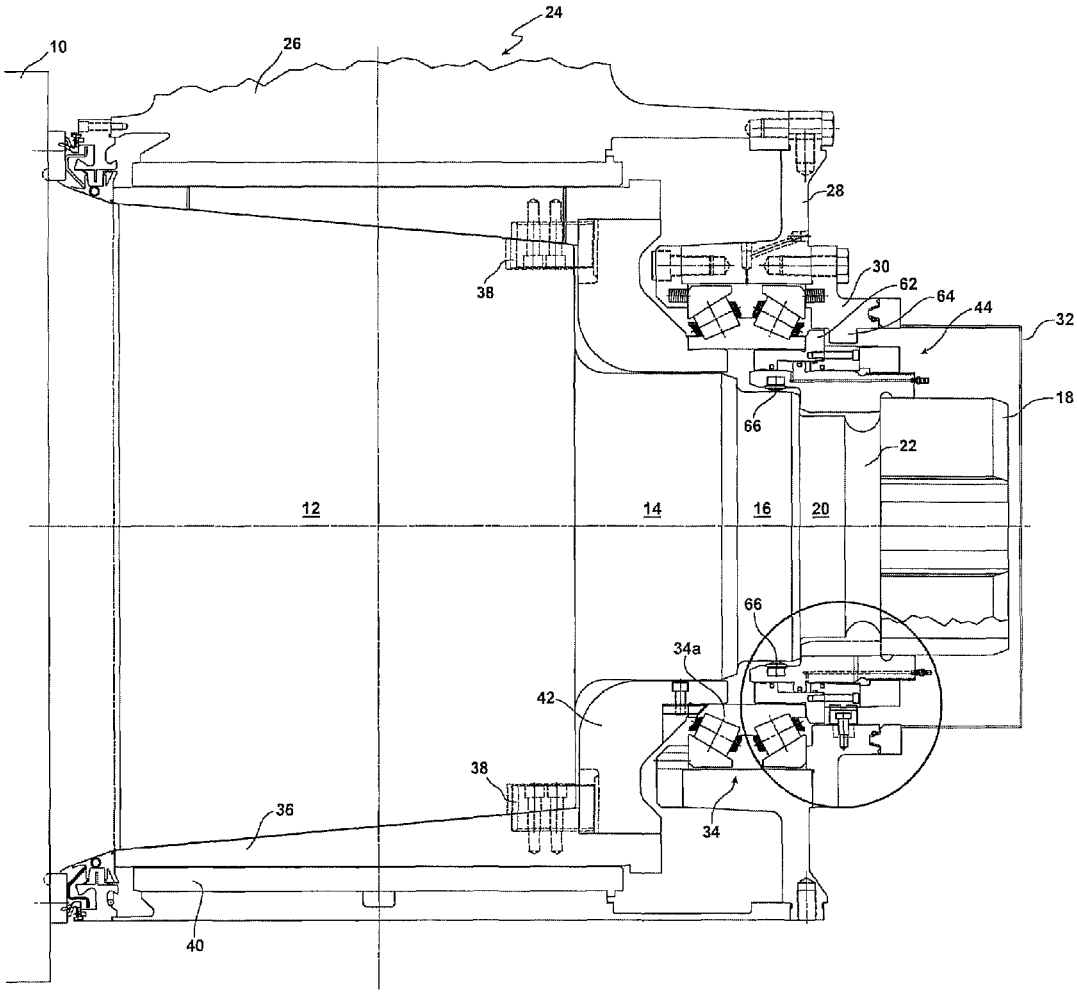
FIG. 1 is a longitudinal sectional view taken through an oil film bearing embodying the concepts of the present invention.

With reference initially to FIG. 1, a rolling mill roll 10 has a tapered section 12 leading to an end having reduced diameter cylindrical intermediate sections 14, 16, the latter being separated from a cylindrical end section 18 by cylindrical section 20 and circular groove 22. An oil film bearing 24 includes a chock 26 cooperating with end plates 28 and 30 and a cover 32 to define a housing containing a thrust bearing 34 and a sleeve bearing comprised of a sleeve 36 rotatably fixed to the tapered neck section 12 by keys 38, with the sleeve in turn being rotatably journalled in a bushing 40 fixed within the chock 26.

A thrust ring 42 is interposed between the sleeve 36 and thrust bearing 34, and a lock assembly 44 coacts with the inner race 34*a* of the thrust bearing 34 to axially retain the oil film bearing on the roll neck.

Figure 2:
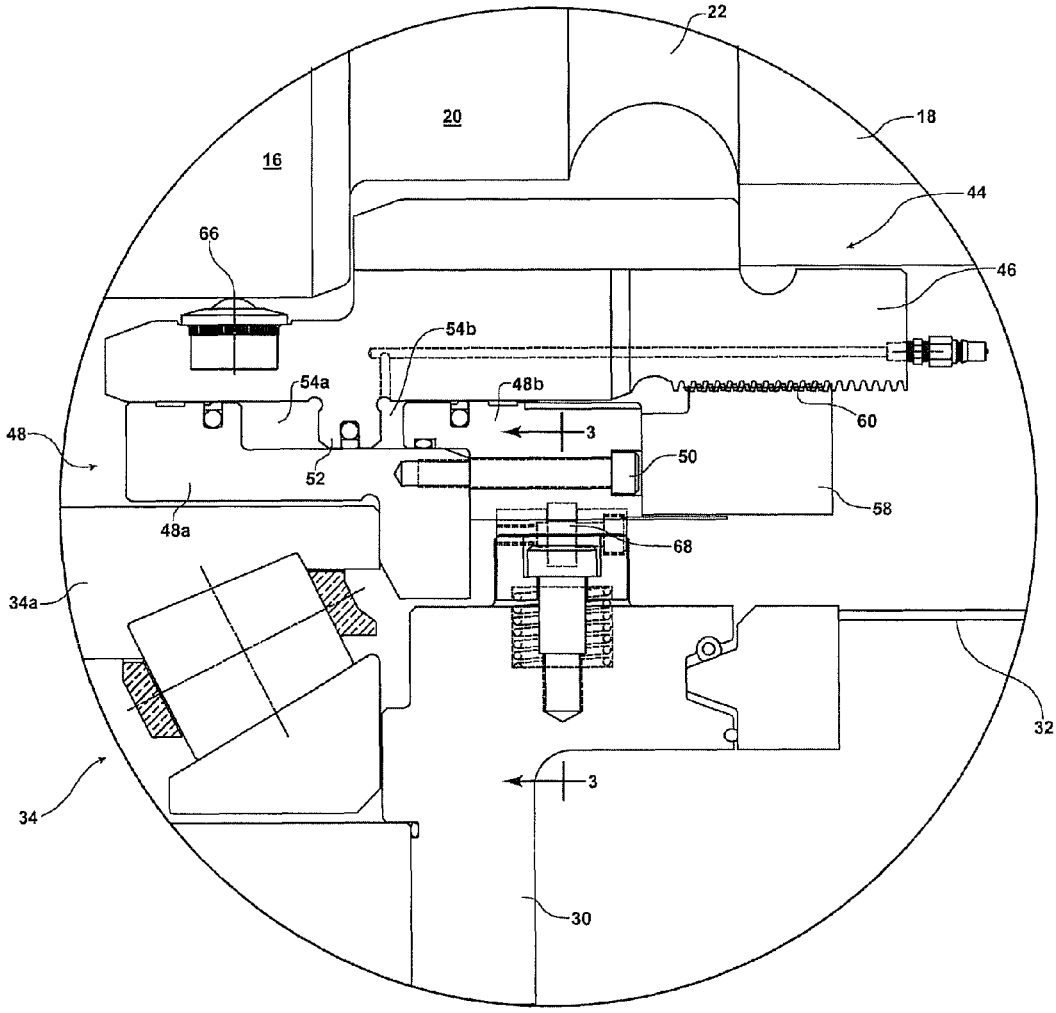
FIG. 2 is an enlarged view of the circled portion of FIG. 1.

As can best be seen by further reference to FIG. 2, the lock assembly 44 includes a piston 46 surrounded by a cylinder 48 comprised of mating ring-shaped components 48*a*, 48*b* interconnected by fasteners 50. The cylinder 48 defines an interior space subdivided by a piston ring 52 into chambers 54*a*, 54*b*.

Figure 9A:
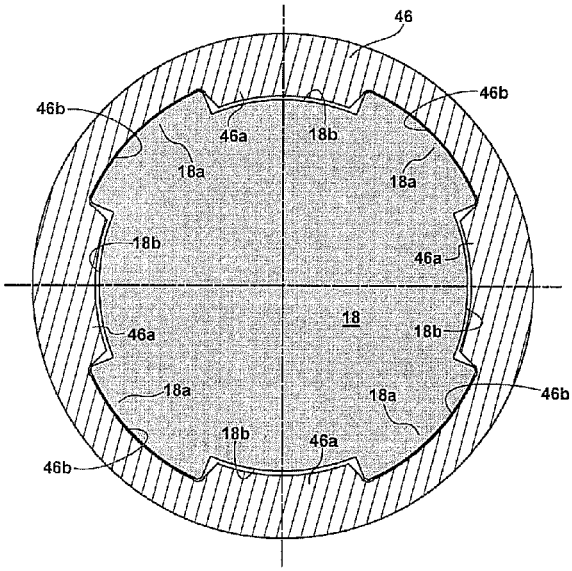
FIGS. 9A and 9B are schematic illustrations depicting successive stages in achieving interlocked engagement of the lock assembly with the roll neck.
Figure 9B:
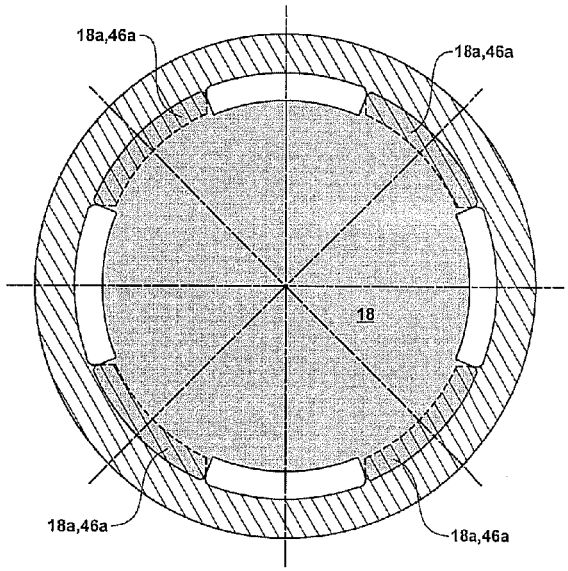

The piston 46 is interengaged with the roll neck by means of a bayonet-type connection. More particularly, with reference to FIG. 9A, the piston 46 has inwardly projecting splines 46*a* angularly separated by grooves 46*b*, and the roll end section 18 has complimentary outwardly projecting splines 18*a* angularly separated by grooves 18*b*. In FIG. 9A, the piston splines 46*a* are aligned axially with the neck grooves 18*b* and the piston grooves 46*b* are aligned with the neck splines 18*a*, thus allowing the lock assembly to be axially mounted on an removed from the roll neck. A shown in FIG. 9B, a 45° rotation of the lock assembly will result in the piston splines 46*a* being aligned with the roll neck splines 18*a*, thus establishing an interlocked interengagement which axially fixes the lock assembly 44 relative to the roll neck.

Once the lock assembly is fixed axially on the roll neck, hydraulic fluid can be introduced into cylinder chamber 54*a* to urge the cylinder 48 to the left as viewed in FIGS. 1 and 2, thus urging the thrust bearing 34 in the same direction to seat the oil film bearing on the roll neck. Thereafter, a lock nut 58 threaded as at 60 on piston 46 is tightened to axially retain the cylinder in place, allowing the hydraulic pressure in chamber 54*a* to be relieved.

Removal of the oil film bearing is accomplished by first loosening the lock nut 58 and then hydraulically pressurizing chamber 54*b*, causing the cylinder 48 to move to the right as viewed in FIGS. 1 and 2. An external shoulder 62 on the cylinder then coacts with an interior ring 64 of outer end plate 30 (see FIG. 1) to axially dislodge the oil film bearing from the roll neck.

As previously noted, during mounting and dismounting of the oil film bearing, the lock assembly 44 has a tendency to tilt and bind. To resist this tendency, first ball-type bearing elements 66 are carried by and project inwardly from the piston 46 to contact the reduced diameter section 16 of the roll neck at a first location. Second roller-type bearing elements 68 project inwardly from the outer end plate 30 to contact the outer surface of the cylinder component 48*b* at a second location spaced axially from the first location contacted by the first bearing elements. The first and second bearing elements 66, 68 coact to resist tilting of the lock assembly, thus avoiding binding as it rotates into and out of interlocked engagement with the roll neck.

Figure 3:
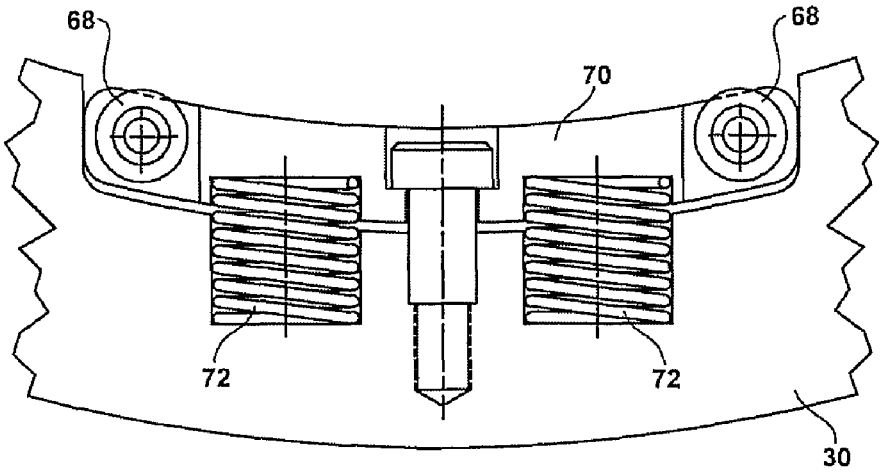
FIG. 3 is a sectional view taken along line 3-3 of FIG. 2.
Figure 4:
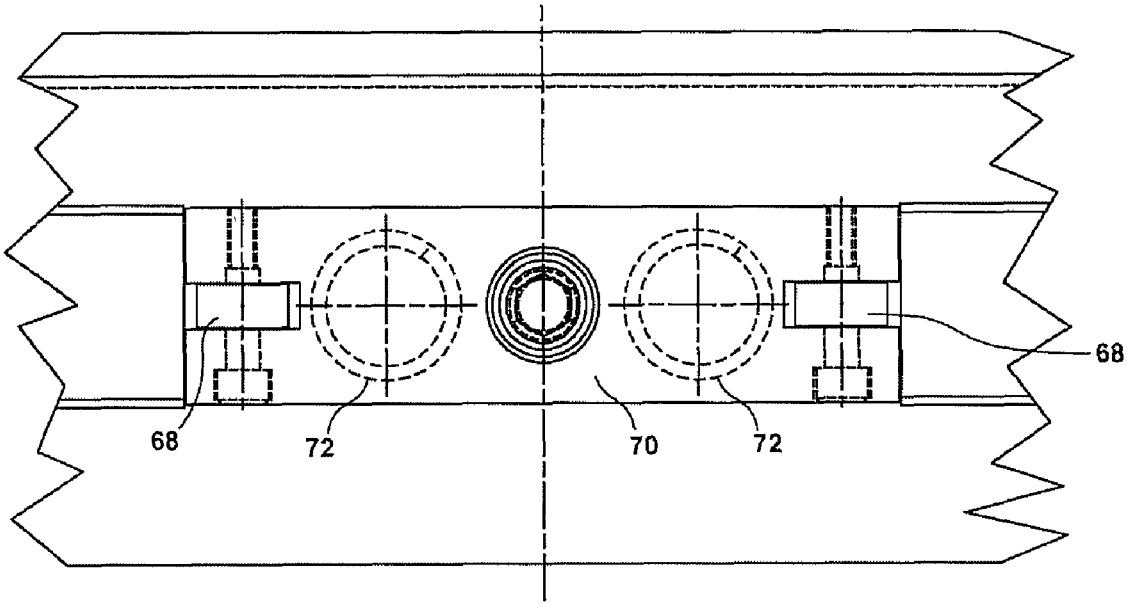
FIG. 4 is a horizontal plan view of the components shown in FIG. 3.
Figure 5:
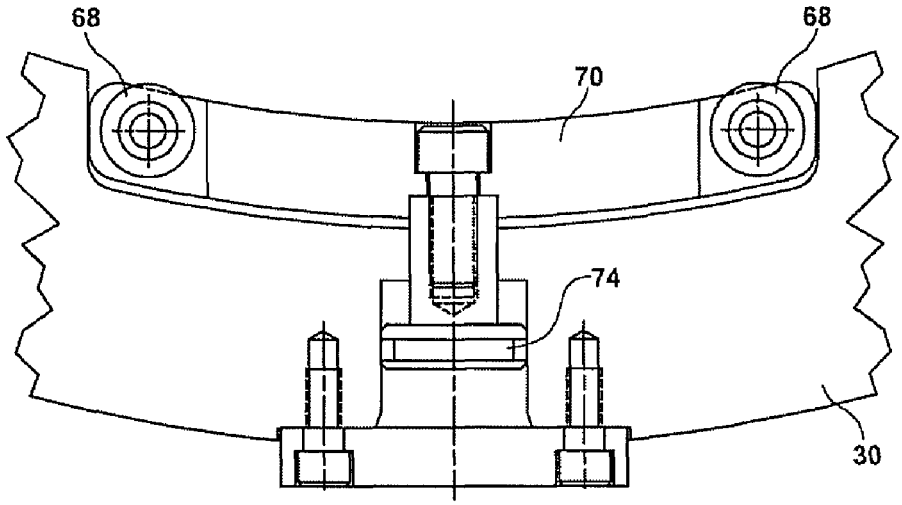
FIGS. 5 and 7, and 6 and 8 are respectively views similar to FIGS. 3 and 4, depicting alternative embodiments of the invention.
Figure 6:
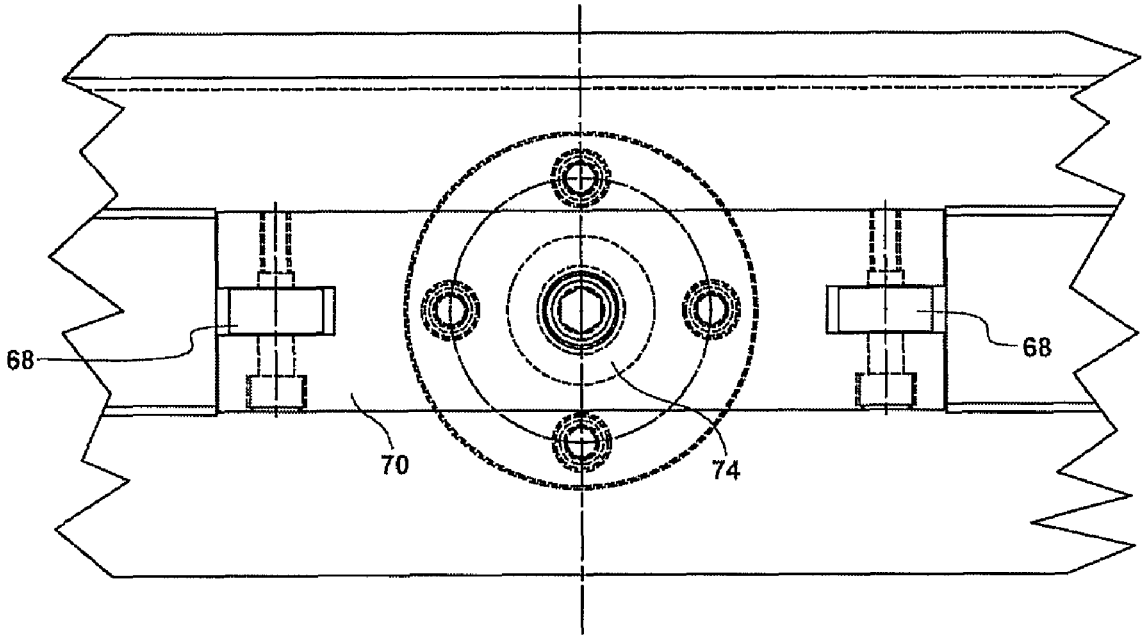

As shown in FIGS. 3 and 4, the roller-type bearing elements 68 may be carried on an arcuate platform 70 urged radially inwardly by resilient force exerting means in the form of springs 72. Alternatively, as shown in FIGS. 5 and 6, the arcuate platform can be urged radially inwardly by hydraulically actuated means in the form of a piston 74.

Figure 7:
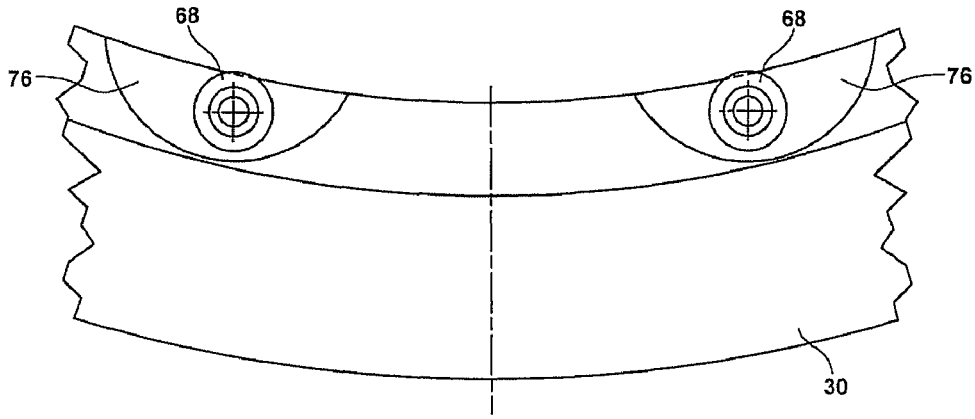
Figure 8:
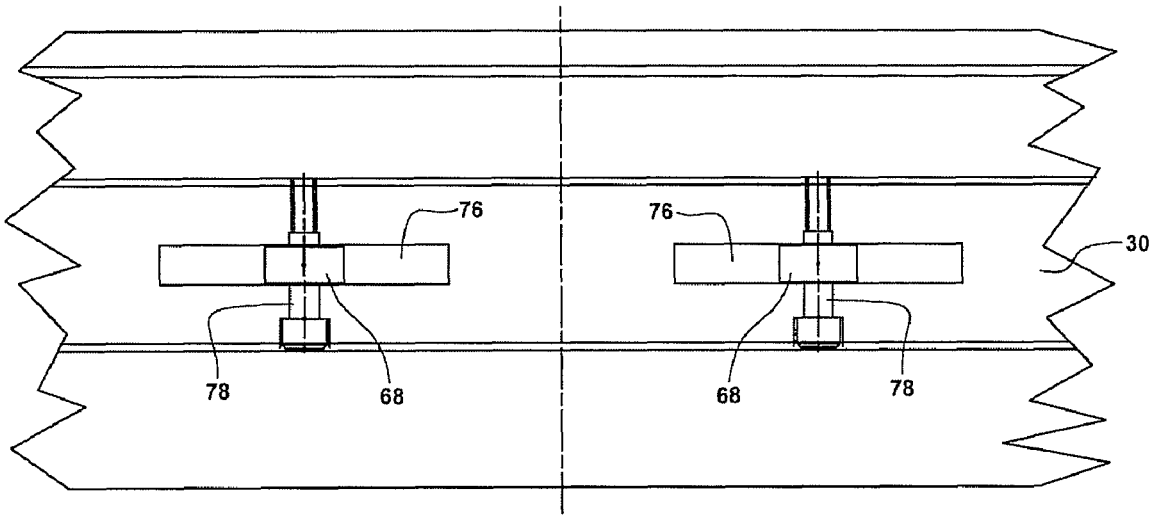

In still another embodiment, as shown in FIGS. 7 and 8, the roller-type bearing elements 68 can simply be located in pockets 76 and rotatably supported on pins 78 fixed with respect to the chock end plate 30.

We claim:

1. An oil film bearing for rotatably supporting the neck of a roll in a rolling mill, said bearing comprising:

a housing containing a sleeve bearing and a thrust bearing;

a circular lock assembly coacting with said thrust bearing to axially retain said bearing on said roll neck, said lock assembly being axially received on and rotatable into and out of mechanical interengagement with said roll neck;

first bearing elements carried by and projecting inwardly from said lock assembly to contact a surface of said roll neck at a first location; and second bearing elements projecting inwardly from said housing to contact an outer surface of said lock assembly at a second location spaced axially from said first location.

2. The oil film bearing of claim 1 wherein said first bearing elements comprise ball-type bearings.

3. The oil film bearing of claim 1 wherein said second bearing elements comprise roller-type bearings.

4. The oil film bearing of claim 3 wherein said second bearing elements are urged radially inwardly by resilient force exerting means.

5. The oil film bearing of claim 4 wherein said second bearing elements are carried on an arcuate platform acted upon by said resilient force exerting means.

6. The oil film bearing of claim 1 wherein said second bearing elements are urged radially inwardly by hydraulically actuated means.

7. The oil film bearing of claim 6 wherein said second bearing elements are carried on an arcuate platform acted upon by said hydraulically actuated means.

8. The oil film bearing of claim 1 wherein said lock assembly is mechanically interengaged with said roll neck by means of a bayonet-type connection.

9. The oil film bearing of claim 1 wherein said circular lock assembly comprises a piston adapted to be mechanically interengaged with said roll neck, and a cylinder surrounding said piston, said first bearing elements being carried by and projecting inwardly from said piston, and said second bearing elements being carried by and projecting inwardly from a component of said housing.

* * * * *